US007306250B1

(12) United States Patent
Mills

(10) Patent No.: US 7,306,250 B1
(45) Date of Patent: Dec. 11, 2007

(54) METHOD OF ATTACHING A MANUALLY OPERATED WHEELCHAIR TO A MOTORIZED SCOOTER

(76) Inventor: Daniel Mills, 295 Newton Sparta Rd., Newton, NJ (US) 07860

( * ) Notice: Subject to any disclaimer, the term of this patent is extended or adjusted under 35 U.S.C. 154(b) by 17 days.

(21) Appl. No.: 10/919,996

(22) Filed: Aug. 17, 2004

(51) Int. Cl.
*A61G 5/10* (2006.01)

(52) U.S. Cl. ..... 280/304.1; 180/11; 180/12; 180/13

(58) Field of Classification Search ..... 180/11, 180/12, 13; 280/304.1
See application file for complete search history.

(56) References Cited

U.S. PATENT DOCUMENTS

| | | | | | |
|---|---|---|---|---|---|
| 2,978,053 | A * | 4/1961 | Schmidt | 180/12 |
| 3,921,744 | A | 11/1975 | Benoit | 180/13 |
| 4,047,686 | A * | 9/1977 | Porter | 248/552 |
| 4,386,672 | A | 6/1983 | Coker | 180/13 |
| 4,892,166 | A | 1/1990 | Gaffney | 180/208 |
| 5,050,695 | A | 9/1991 | Kleinwolterink | 180/13 |
| 5,207,286 | A * | 5/1993 | McKelvey | 180/13 |
| 5,494,126 | A | 2/1996 | Meeker | 180/13 |
| 5,697,628 | A * | 12/1997 | Spear | 280/304.1 |
| 5,826,670 | A * | 10/1998 | Nan | 180/15 |
| 6,231,283 | B1 | 5/2001 | Stowers | 410/9 |
| 6,474,916 | B2 * | 11/2002 | Constantin | 410/7 |
| 6,834,734 | B2 * | 12/2004 | Wu | 180/65.5 |
| D508,093 | S * | 8/2005 | Wu | D21/421 |
| 2003/0160424 | A1 * | 8/2003 | Catanescu et al. | 280/304.1 |
| 2004/0000440 | A1 * | 1/2004 | Sawyer | 180/13 |

* cited by examiner

*Primary Examiner*—Lesley D. Morris
*Assistant Examiner*—Marlon Arce-Diaz
(74) *Attorney, Agent, or Firm*—Steven B. Stein

(57) ABSTRACT

A method of attaching a manually operated wheelchair to a motorized scooter using an angle iron, an adjustable bar that has a left segment, a middle segment, a right segment and a pair of adapters. A user slides the middle segment over the left and right segments, and inserts screws into left and right holes in the middle segment and aligned holes in the left and right segments. The user then screws the adapters onto upper ends of the left and right segments and snaps them into position on the underside of the wheelchair. Next, the user removes the seating apparatus from the scooter, fastens the angle iron to the floor of the scooter by inserting a pair of bolts through the slots in the angle iron and tightening the bolts with a pair of matching nuts, and places the bar squarely against the angle iron.

4 Claims, 3 Drawing Sheets

METHOD OF ATTACHING A MANUALLY OPERATED WHEELCHAIR TO A MOTORIZED SCOOTER

BACKGROUND OF THE INVENTION

1. Field of the Invention

The invention generally relates to wheelchairs, and in particular it relates to a method of securely attaching a manually operated wheelchair to a motorized scooter.

2. Description of the Related Art

On the average, Americans are living longer now than ever before thanks to medical technological advances and increased health awareness. As the population grows older, more and more people are experiencing the often cruel ravages inflicted by the aging process. Senior citizens often suffer from varying degrees of impaired mobility and consequently experience difficulties in getting around. Moreover, impaired mobility is not limited to the elderly. To the contrary, many individuals from all age groups cope with this phenomenon every day on a temporary or permanent basis. These people are routinely confronted with numerous problems that cannot be envisioned, much less fully understood, by the majority of the population that is fortunate enough to have all of their physical faculties intact. Fortunately, manually operated and mechanized wheelchairs are commercially available to those in need.

Manually operated wheelchairs are significantly less expensive than their motorized counterparts and are consequently in much wider use. An elderly or disabled consumer can purchase a manually operated wheelchair for a few hundred dollars but must spend about six thousand to seven thousand dollars to acquire a motorized version. However, certain disadvantages are typically associated with utilizing manually operated wheelchairs. Most notably, the user must expend a lot of physical effort rotating the outside wheels of the device in order to travel from one location to another. Thus, the user generally becomes tired and weary in a relatively short period of time. The user often requires another person to push the wheelchair in which he sits to complete long excursions, an untenable or at least uncomfortable predicament. Hence, there is a pressing need for a method of effectively converting a manually operated wheelchair to an affordable motorized wheelchair by securely attaching it to a scooter.

U.S. Pat. No. 3,921,744 to Benoit et al. ("Benoit") teaches a wheelchair with a detachable drive means. However, a user must exert considerable energy attaching and detaching the drive means to the wheelchair of Benoit.

U.S. Pat. No. 4,386,672 to Coker ("Coker") discloses a battery-powered electric drive unit that detachably connects to a conventional wheelchair. However, the drive unit of Coker is highly complex and has little practical utility.

U.S. Pat. No. 4,892,166 to Gaffney ("Gaffney") teaches a device for coupling a front wheel unit of a motorized wheelchair with a rear wheel unit to obtain an assembled motorized wheelchair. However, the device of Gaffney is useless with manually operated wheelchairs.

U.S. Pat. No. 5,050,695 to Kleinwolterink ("Kleinwolterink") discloses a unit that is adapted to easily attach to a conventional wheelchair and convert it to a motorized wheelchair. However, the unit of Kleinwolterink is excessively bulky and very cumbersome.

U.S. Pat. No. 5,494,126 to Meeker ("Meeker") teaches an apparatus and method for attaching a motorized wheel to a manually operated wheelchair. However, the apparatus and method of Meeker are extraordinarily complex and impractical.

U.S. Pat. No. 5,826,670 to Nan ("Nan") discloses a detachable propulsive device for a wheelchair. However, the device of Nan does not provide an area in which the user can rest his feet while riding.

U.S. Pat. No. 6,231,283 B1 to Stowers ("Stowers") teaches an apparatus that anchors a vehicle such as a wheelchair in place. However, the apparatus of Stowers does not transport a wheelchair user from one location to another.

While these devices may be suitable for the particular purposes employed, or for general use, they would not be as suitable for the purposes of the present invention as disclosed hereafter.

SUMMARY OF THE INVENTION

It is an object of the invention to provide a method that involves means which securely attach to a manually operated wheelchair. Accordingly, the method uses a pair of adapters positioned at opposite ends of a U-shaped adjustable bar to fasten the bar to the underside of the wheelchair.

It is another object of the invention to provide a method that includes means which anchor the bar in place. Accordingly, the method uses a 90° angle iron that is located below the bar and fastened to the floor of a scooter with a pair of bolt-and-nut combinations.

It is a further object of the invention to provide a method that includes means to keep the cross braces of the wheelchair even during use. Accordingly, a circular, self-adhesive rubber bumper is attached to the scooter.

It is a further object of the invention to provide a method that allows a user to utilize the wheelchair separately after mounting it onto the scooter. Accordingly, a method of disassembling the wheelchair/scooter combination is provided.

The invention is a method of attaching a manually operated wheelchair to a motorized scooter using an angle iron, an adjustable bar that has a left segment, a middle segment, a right segment and a pair of adapters. A user slides the middle segment over the left and right segments, and inserts screws into left and right holes in the middle segment and aligned holes in the left and right segments. The user then screws the adapters onto upper ends of the left and right segments and snaps them into position on the underside of the wheelchair. Next, the user removes the seating apparatus from the scooter, fastens the angle iron to the floor of the scooter by inserting a pair of bolts through the slots in the angle iron and tightening the bolts with a pair of matching nuts, and places the bar squarely against the angle iron.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
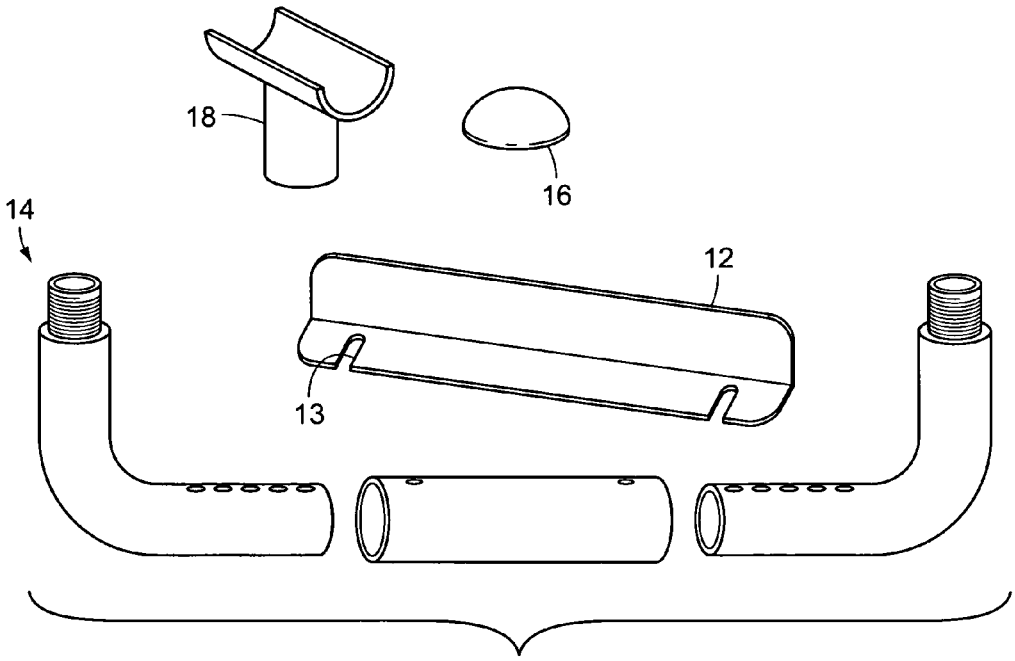
FIG. 1 is a diagrammatic perspective view of the mechanical components that are used in the steps of the method of the present invention.
Figure 2:
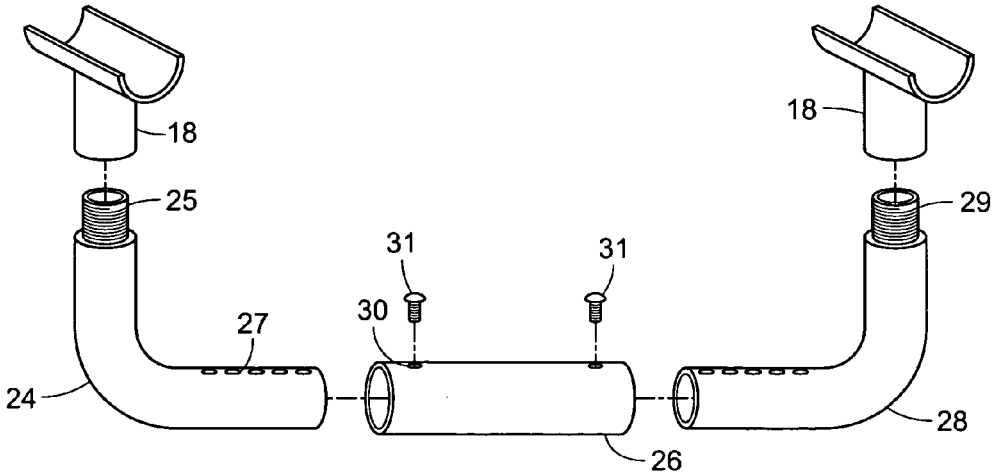
FIG. 2 is a diagrammatic perspective view of the adjustable bar being utilized according to the method of the present invention.
Figure 3:
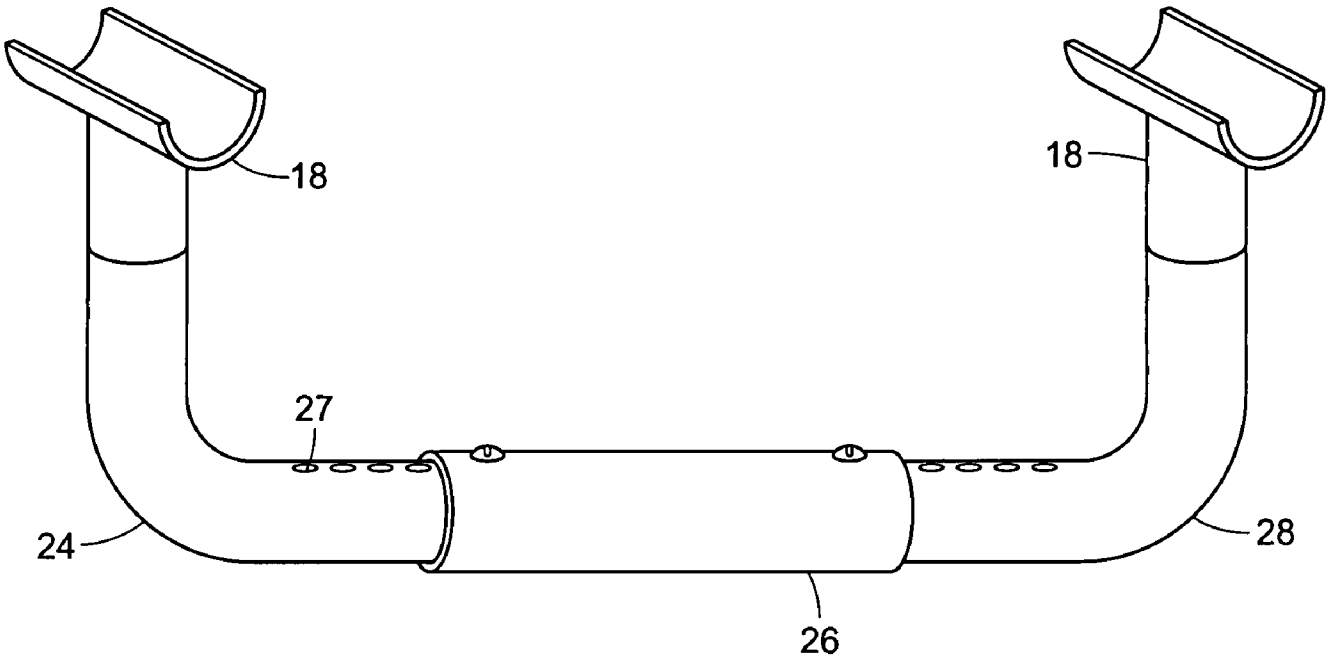
FIG. 3 is a diagrammatic perspective view of the adjustable bar in a locked position.

FIG. 1 depicts the mechanical components that are used in the steps of the method of the present invention. These components include a 90° angle iron 12 with a pair of elongated slots 13 embedded therein, a U-shaped adjustable bar 14, a circular, self-adhesive rubber bumper 16 and an adapter 18 that has a concave-up orientation. As shown in FIGS. 2 and 3, the bar 14 consists of an L-shaped left segment 24 with an upper end 25, a symmetric right segment 28 with an upper end 29 and a straight middle segment 26 that has a slightly larger diameter than the left segment 24 and the right segment 28. A plurality of linearly positioned threaded holes 27 is embedded in corresponding areas of the left segment 24 and the right segment 28. The middle segment 26 has left and right holes 30.

Figure 4:
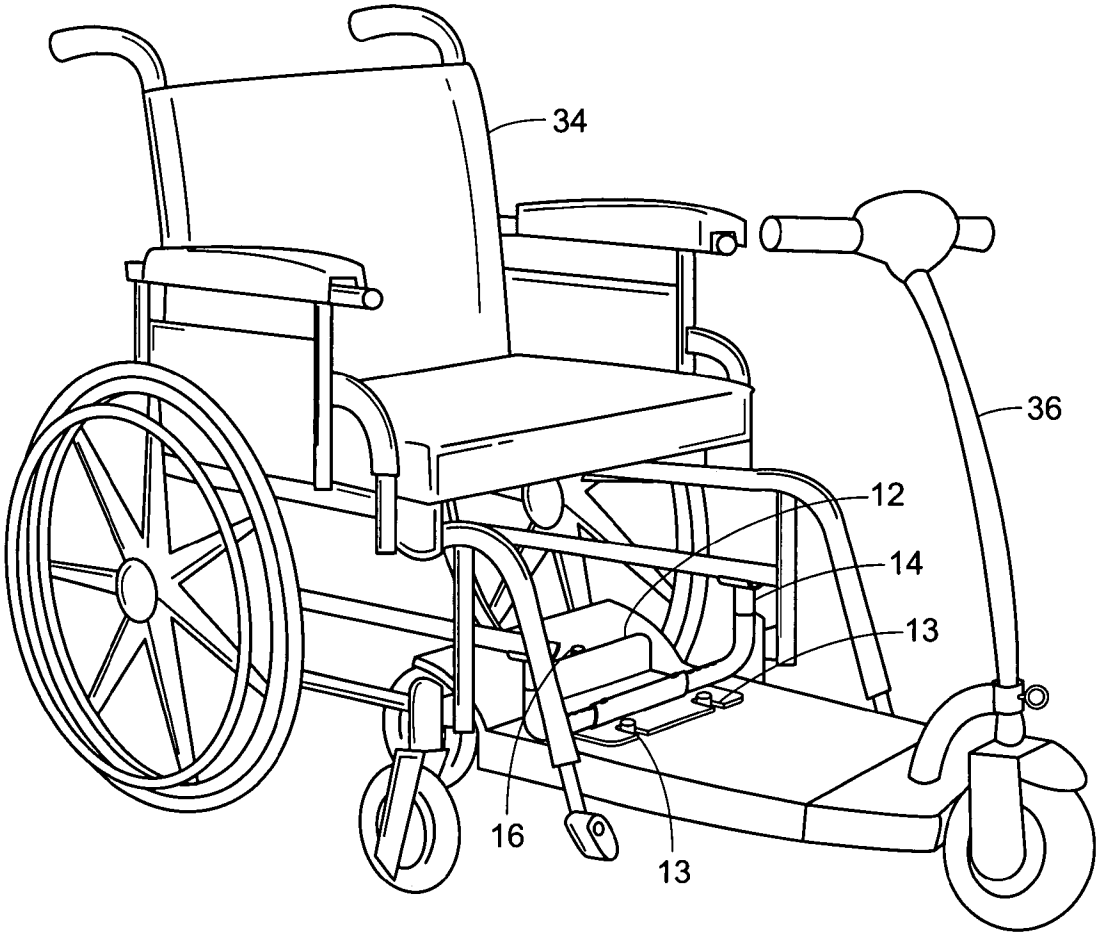
FIG. 4 is a diagrammatic perspective view of a manually operated wheelchair mounted onto a motorized scooter according to the method of the present invention.

According to the present method, a user telescopically slides the middle segment 26 over the left segment 24 and the right segment 28 until the width of the bar 14 is substantially equal to the width of a manually operated wheelchair 34. The user then inserts two screws 31 into the left and right holes 30 in the middle segment 26 and the nearest aligned holes in the left segment 24 and the right segment 28. In order to attach the bar 14 to the wheelchair 34, the user screws an adapter 18 onto the upper end 25 of the left segment 24 and the upper end 29 of the right segment 28. The user firmly snaps the adapters 18 into position on the underside of the wheelchair 34. Next, the user removes the seating apparatus and supporting structure from a motorized scooter 36. The user fastens the angle iron 12 to the floor of the scooter by inserting a pair of bolts through the slots 13 and tightening them with a pair of matching nuts. As illustrated in FIG. 4, in order to mount the wheelchair 34 onto the floor of the scooter 36, the user places the bar 14 squarely against the vertical wall of the angle iron 12. The user attaches the bumper 16 to the scooter 36 in order to keep the cross braces of the wheelchair 34 even during use. The user can then sit in the wheelchair 34, rest his feet on the floor of the scooter 36 and fully enjoy the significant benefits of traveling in a converted motorized wheelchair.

If the user subsequently wishes to again utilize the wheelchair 34 separately, he then disassembles the wheelchair 34/scooter 36 combination. To do so, he first detaches the adapters 18 from the underside of the wheelchair 34 by snapping them free. He then loosens the bolt-and-nut combinations in the slots 13 and lifts the angle iron 12 from the floor of the scooter 36. If the user decides that he prefers to operate the wheelchair 34 manually, he can reinstall the seating apparatus and supporting structure on the scooter 36. He can also disassemble the bar 14 by unscrewing the adapters 18 from the upper end 25 of the left segment 24 and from the upper end 29 of the right segment 28, removing the screws 31 from the left and right holes 30 in the middle segment 26 and sliding the left segment 24 and the right segment 28 out of the middle segment 26.

In conclusion, herein is presented a method of attaching a manually operated wheelchair to a motorized scooter. The invention is illustrated by example in the drawing figures, and throughout the written description. It should be understood that numerous variations are possible, while adhering to the inventive concept. Such variations are contemplated as being a part of the present invention.

What is claimed is:

1. A method of attaching a manually operated wheelchair to a motorized scooter having a seating apparatus and supporting structure and a floor, the method using an angle iron, an adjustable bar, a circular rubber bumper and a pair of adapters, the angle iron having a vertical wall and a horizontal wall that form a right angle and a pair of embedded elongated slots, the bar having elbow shaped left and right segments and a straight middle segment therebetween, the left and right segments having a plurality of linearly positioned holes embedded therein, the middle segment being slightly wider than the left and right segments, the middle segment having left and right holes, the adapters each having a concave-up orientation, the method comprising the steps of:

telescopically sliding the middle segment over the left segment and the right segment until the width of the bar is substantially equal to the width of the wheelchair;

inserting a pair of screws into the left and right holes in the middle segment and aligned holes in the left and right segments;

attaching the bar to the wheelchair by (a) screwing one adapter onto an upper end of the left segment; (b) screwing the other adapter onto an upper end of the right segment; and (c) firmly snapping the adapters into position on an underside of the wheelchair;

removing the seating apparatus and supporting structure from the scooter;

fastening the angle iron to the floor of the scooter; and placing the bar squarely against the vertical wall of the angle iron.

2. The method of attaching a manually operated wheelchair to a motorized scooter as recited in claim 1, wherein the step of fastening the angle iron to the floor of the scooter further comprises the steps of:

inserting a pair of bolts through the slots in the angle iron; and tightening the bolts with a pair of matching nuts.

3. The method of attaching a manually operated wheelchair to a motorized scooter as recited in claim 2, further comprising the step of attaching the bumper to the scooter to keep cross braces of the wheelchair even during use.

4. A method of disassembling a manually operated wheelchair from a motorized scooter having a seating apparatus and supporting structure and a floor, the method using an angle iron, an adjustable bar and a pair of adapters, the angle iron having a pair of embedded elongated slots, the bar having elbow shaped left and right segments and a straight middle segment therebetween, the left and right segments having a plurality of linearly positioned holes embedded therein, the middle segment being slightly wider than the left and right segments, the middle segment having left and right holes, the method comprising the steps of:

detaching the adapters from an underside of the wheelchair by snapping them free;

loosening bolt-and-nut combinations in the slots in the angle iron;

lifting the angle iron from the floor of the scooter;

reinstalling the seating apparatus and supporting structure on the scooter;

disassembling the bar;

unscrewing an adapter from an upper end of the left segment;

unscrewing an adapter from an upper end of the right segment;

removing screws from the left and right holes in the middle segment; and sliding the left segment and the right segment out of the middle segment.

* * * * *